United States Patent [19]

Gold et al.

[11] 4,341,311

[45] Jul. 27, 1982

[54] METHOD AND APPARATUS FOR SORTING RIVETS

[75] Inventors: Raymond D. Gold, Waukee; Robert A. Tufts, Bondurant; Merle S. Schillerstrom, Des Moines, all of Iowa

[73] Assignee: Deere & Company, Moline, Ill.

[21] Appl. No.: 180,775

[22] Filed: Aug. 25, 1980

[51] Int. Cl.[3] ..... B07C 5/00

[52] U.S. Cl. ..... 209/644; 209/657; 209/658; 209/686; 209/940; 209/929

[58] Field of Search ..... 209/929, 657, 659, 686, 209/920, 924, 940, 644, 658; 10/129 WJ, 139 WJ, 162 A

[56] References Cited

U.S. PATENT DOCUMENTS

| | | | |
|---|---|---|---|
| 166,153 | 7/1875 | Shelton | 209/686 |
| 2,310,661 | 2/1943 | Veit | 209/929 |
| 2,378,711 | 6/1945 | Kuehlman | 209/929 X |
| 2,716,487 | 8/1955 | Cox | 209/929 X |
| 3,731,795 | 5/1973 | Velthoven | 209/929 X |
| 4,295,570 | 10/1981 | Hakoi | 209/940 X |

*Primary Examiner*—Allen N. Knowles

[57] ABSTRACT

A method of sorting rivets or similarly shaped articles, and apparatus therefor. Rivets are directed along a track to a notch where they are supported in a shank-down attitude against a rotating gauging wheel having a plurality of gauging holes conforming generally to the shape of the shank. The wheel is rotated so the gauging holes move upwardly with respect to the shanks while grooves in the periphery of the wheel guide the shanks toward the holes. Rivets with a uniform shank will settle into the holes so their heads are below the periphery, while rivets with bent, gouged, burred or oversized shanks will not settle fully into the holes. A rivet kicker timed to the rotation of the wheel ejects rivets not fully settled in the holes. Fully settled rivets are blown out of the gauging holes into a tube where they are conveyed by air towards a riveting machine.

25 Claims, 12 Drawing Figures

METHOD AND APPARATUS FOR SORTING RIVETS

BACKGROUND OF THE INVENTION

The present invention relates generally to gauging or sorting articles of manufacture, and more specifically to a method and device for sorting rivets or similar articles with headed shanks according to shank condition.

When an automatic riveter is utilized to assemble components, the rivets used therein must be uniform in size and shape so the machine will not jam or clog and so the connections formed by the rivets will be sound. The shanks of the rivets often carry oxidation or debris as a result of the annealing process which they undergo during manufacture, and it is not uncommon for shanks to be bent, gouged, burred, non-round, or swaged at the end. These and other similar non-uniformities often cause the riveting machine to jam or result in an inferior riveted connection and thus an inferior assembled product.

Various methods and devices presently available will sort articles with headed shanks according to shank length, and some sort according to shank diameter at a particular axial location on the shank. For example, a vibratory bowl qualifier checks the diameter of the rivet in only one place, thereby allowing bent rivets, burred rivets, and rivets with foreign material deposits on them to pass through. Heretofore, none of the methods and devices for sorting have been entirely successful in detecting and sorting out those articles which have non-uniformities other than completely oversized shanks or shanks which are oversized at the gauging location. Presently available methods and devices do not reliably detect burrs, gouges, swaged ends, bent or non-round shanks, or oxidation or debris.

It is therefore an object of the present invention to provide an improved method and apparatus for sorting articles with headed shanks such as rivets.

It is another object of the invention to provide an automated method of reliably sorting out non-uniform rivets or the like from a batch of rivets and directing the uniform rivets to a feeder of an automatic riveting machine, and to provide an inexpensive and yet reliable sorting machine therefor.

It is still another object of the invention to provide a method and apparatus for automatically gauging rivets and reliably rejecting rivets with oversized, bent, or burred shanks. It is a further object to provide an automatic rivet gauging apparatus which is very reliable and yet has relatively few moving parts.

The sorter is fed from a vibratory bowl sorter. Each rivet is directed in turn down a track and settles in a notch at the lower end of the track. A roller mounted on a rockable arm member retains the rivet in the notch and biases the shank against the rim of a rotating wheel. A groove or guide tapering radially inwardly from the rim of the wheel terminates in a shank-receiving gauge hole in the wheel conforming generally to the desired shape of the shanks. As the wheel rotates, the rivet is held in the groove and as the gauge hole in the wheel passes by the rivet, the rivet shank slides down the groove and enters the hole in the wheel. The rivet is carried past an air-operated rivet ejection cylinder. A cam located on the wheel operates an air switch which triggers the air cylinder. Any rivet which does not fully enter the gauge hole will be exposed to a rivet kicker on the ejection cylinder and will be ejected from the wheel into a chute for defective rivets. Acceptable rivets are carried in the wheel past the ejection cylinder to a point where an air hole in the side of the wheel aligns with an air supply hole, thereby acting as a rotary valve which passes air into the gauge hole. The air blows the acceptable rivet into a barrel where a continuous charge of air removes the rivets to a hopper adjacent the riveting machine. Therefore, rivets with shanks which are irregular will be ejected from the wheel and prevented from entering the hopper of the riveter so that the riveter operates more effectively and so that incidences of poor connections resulting from irregular rivets are reduced.

These and other objects, features, and advantages will become apparent to one skilled in the art upon reading the following detailed description taken with the drawings.

DESCRIPTION OF THE PREFERRED EMBODIMENT

Figure 1:
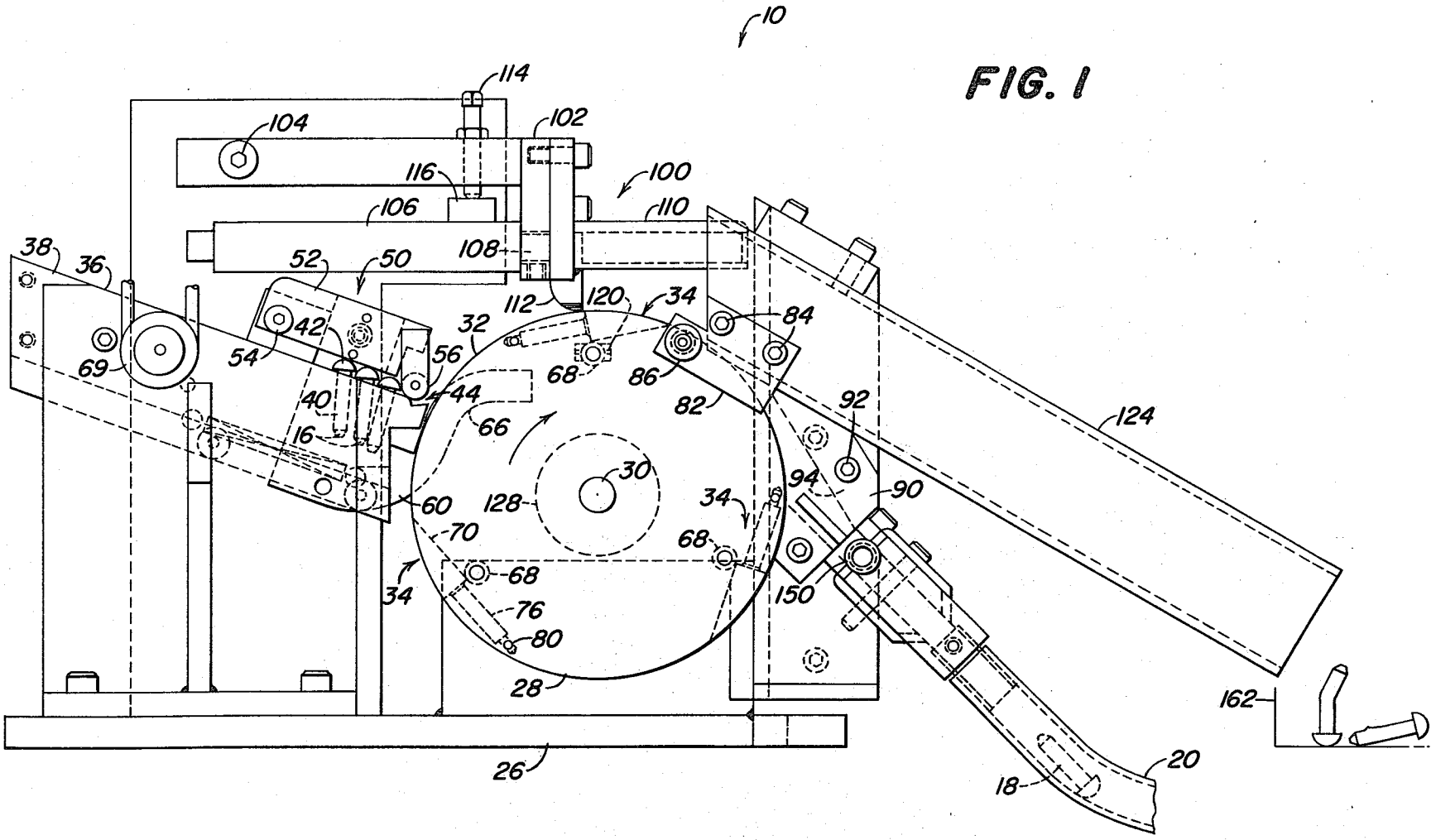
FIG. 1 is a side view of the rivet sorter of the present invention.

Referring to FIG. 1 therein is shown generally at 10 the rivet sorter of the present invention. In the preferred embodiment, the rivet sorter 10 is fed from a vibratory bowl qualifier or presorter 12 (FIG. 2) commercially available from the Syntron Material Handling Equipment Division, Homer, Pa. An inclined guide 14 is connected between the qualifier 12 and the sorter 10 for directing rivets 16 to the sorter 10. Acceptable rivets 18 after being gauged by the sorter 10 are directed through a flexible transfer tube 20 to a feeder indicated at 22 which in the preferred embodiment is a vibratory bowl feeder also available from Syntrol. Connected to the bowl feeder 22 is an automatic riveting machine (not shown) which receives the acceptable rivets 18 from the sorter 10 via a guide 24.

Figure 4:
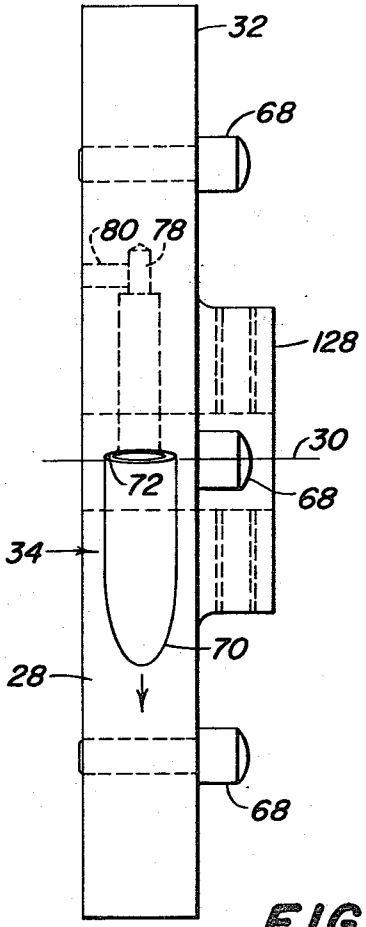
FIG. 4 is a view of the rotating member taken along lines 4—4 of FIG. 3.

As best seen in FIG. 1, the rivet sorter 10 includes a frame 26 supporting a cylindrically shaped gauge wheel or member 28 for rotation about a generally horizontal axis 30. Spaced equidistantly about the periphery or rim portion 32 of the wheel 28 are a plurality of gauging locations 34. In the preferred embodiment three locations 34 are spaced 120° apart. As best seen in FIG. 4, the locations 34 are centered with respect to the front and rear faces of the member 28.

Also supported on the frame 26 is an inclined track member 36 which is connected to and receives rivets 16 from the guide 14 of the bowl qualifier 12. The inclined track member 36 includes a pair of generally identical spaced plates 38 defining a slot therebetween which is sufficiently wide to receive the rivet shanks 40. The plates 38 are spaced apart a distance less than the circumference of the heads 42 of the rivets 16. Therefore the rivets are supported along the inclined track member 36 in a shank-down attitude from their heads 42. The inclined track member 36 is perpendicular to the axis 30 of the gauge wheel 28 and terminates in a notch 44 adjacent the periphery 32 of the wheel. The notch 44 includes a substantially horizontal headreceiving portion 46 and a rear curved slide section 47. As best seen in FIG. 1, the plane of the portion 46 is located above a horizontal plane which passes through the axis 30 of the gauge wheel 28. The distance between the slide section 47, which forms the left-most edge of the notch 44 as viewed in FIG. 1, and the periphery 32 of the wheel 28 is approximately equal to the diameter of the rivet head 42.

Figure 6:
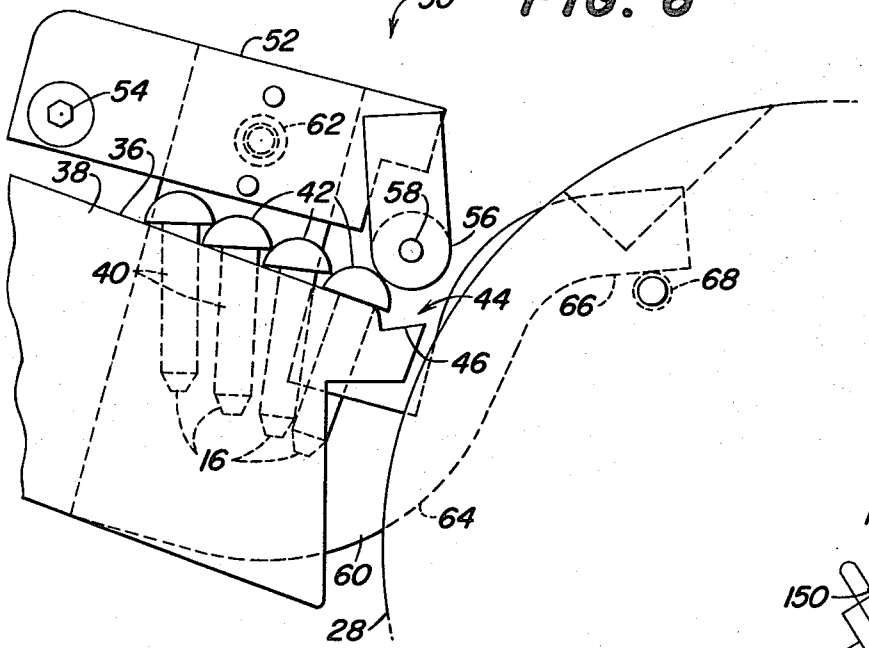
FIG. 6 is an enlarged view of the indexing mechanism on the sorter of FIG. 1 with the roller being lifted by the cam on the rotating member to permit another rivet to be positioned in the notch at the end of the slide.

A rivet indexing mechanism 50 supported above the member 28 includes an arm 52 connected by a pivot pin 54 to and rockable with respect to the frame 26. The arm 52 supports a roller 56 between a pair of roller brackets 57 just above the notch 44 for rotation about an axis 58 generally parallel to the axis 30 of the gauge wheel 28. An arm operating lever 60 (FIG. 6) is pinned or otherwise rigidly connected to the arm 52 at location 62 and extends downwardly therefrom along the rear plate 38 to a bottom S-shaped portion which extends to the right and upwardly adjacent the rear side of the gauge wheel 28 (as viewed in FIG. 1) and terminates in a camming portion 66. A thimble-shaped cam 68 is pressed into a hole in the wheel 28 near each of the gauging locations 34. As the wheel 28 rotates in the clockwise direction, each cam 68 engages the camming portion 66 of the lever 60 to raise the lever 60 and arm 52 as the gauging location passes the notch 44 (FIG. 6). The rivet indexing mechanism 50 is thus timed to the rotation of the wheel 28, and the roller 56 is raised to release a new rivet 16 into the notch 44 after the previous rivet is removed by a gauging location. The roller 56 also assures a smooth release of the rivet from the notch 44, as will be discussed in detail later.

Figure 7C:
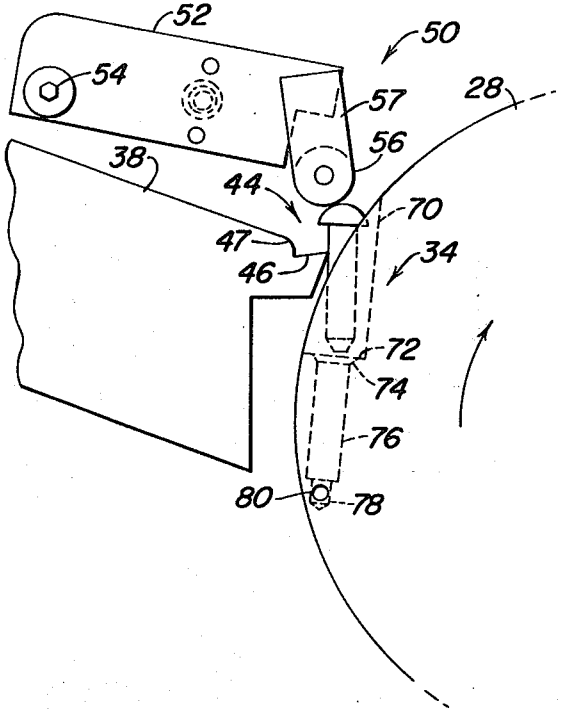
FIG. 7*c* is a view similar to FIG. 7*b* but showing the shank of the rivet as it is lifted from the notch and begins to enter the gauging hole in the rotating member.
Figure 7B:
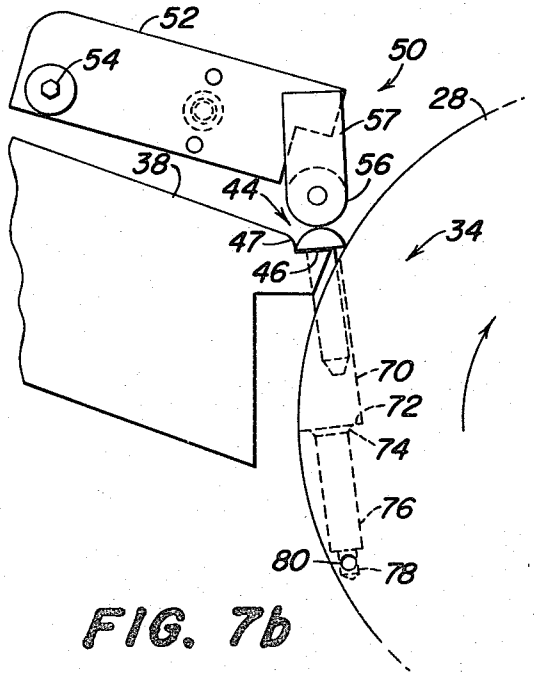
FIG. 7*b* is a view similar to FIG. 7*a* but showing the shank of the rivet entering the groove on the periphery of the rotating member.
Figure 7A:
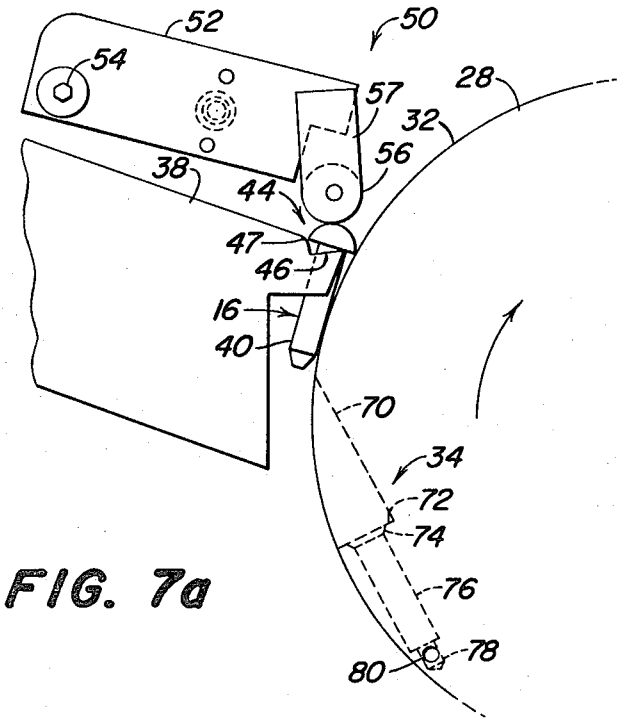
FIG. 7*a* is a view of the arm member holding a rivet against the rim of the rotating member.

An air-operated vibrator 69 (FIG. 1), which in the preferred embodiment is a Model BD-10 vibrator, commercially available from Martin Engineering, is connected to the front plate 38 to vibrate the inclined track member 36 and assure that the rivets 16 will slide down the track to the lowermost position. As the wheel 28 rotates, the shank 40 of the rivet depending from the notch 44 is received by the gauging location 34 as it passes the notch (FIG. 7*a*–7*c*). The rivet is lifted from the notch 44 by frictional contact with the gauging location upon continued rotation of the wheel 28 in the clockwise direction as the rivet indexing mechanism 50 is raised to lift the roller 56. As the rivet indexing mechanism 50 continues to be raised by the cam 68 on the wheel 28, a new rivet 16 slides into the notch 44 under the roller 56.

Figure 8:
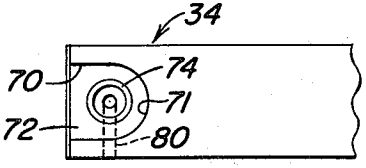
FIG. 8 is a view of a gauging location taken along lines 8—8 of FIG. 3.

Each gauging location 34 includes a rounded groove or guide portion 70 approximately centered with respect to the transverse dimension of the periphery 32 (FIG. 4) and diverging in the transverse direction as it increases in depth in a direction opposite the direction of rotation as indicated by the arrows in the figures. The rounded groove 70 terminates in an end portion 72 which in the preferred embodiment extends inwardly from the periphery or rim portion 32 a distance approximately equal to the diameter of the head 42 of the rivet 16. The groove 70 has an axial length approximately equal to that of the rivet 16, and the radius of the lower surface 71 (FIG. 8) of the groove 70 is approximately equal to the radius of the head 42. The end portion 72 tapers at location 74 to a cylindrically shaped aperture or hole 76 extending inwardly from the periphery 32 and having a diameter just slightly larger than the diameter of the shank 40 of a rivet 16. The length of the cylindrically shaped aperture 76 is approximately equal to the length of the shank 40 of each of the rivets to be gauged. The axis of the aperture is approximately perpendicular to a line extending radially from the center of the member 28 through a gauging location 34. In the preferred embodiment, when the end portion 72 is in the position shown in FIG. 7*b*, the axis of the aperture 76 is angled toward the notch 44 approximately 10° from the vertical. A rivet with a uniform shank will settle into the gauging location with the aid of the roller 56 (FIG. 7*c*) so that the bottom of its head 42 (FIG. 5*a*) is against the end portion 72 and is within the circumference of the member 28.

Extending coaxially from the bottom of the aperture 76 is a bore 78. An air-feed hole 80 extends through the front side of the rotating member 28 and intersects the bore 78. An air flow path is therefore provided between the front face of the member 28 and the cylindrically shaped aperture 76 by the bore 78 and the air-feed hole 80.

A block 82 is supported on the frame 26 (FIG. 1) by a pair of bolts 84 and includes a flat rear surface parallel and closely adjacent to the front face of the rotating member 28. An air supply hole 86 extends through the block and is located the same radial distance from the axis 30 of the rotating member 28 as the air-feed holes 80 associated with each of the gauging locations 34. A constant supply of air pressure is provided to the hole 86 which cooperates with the air-feed holes 80 to act as a rotary valve which passes air into the cylindrically shaped aperture 76 as the corresponding gauging location 34 is rotated over top center and reaches the area of the block 82. Therefore if a rivet is positioned in the aperture 76 when the gauging location 34 reaches the block 82, the rivet will be forcefully ejected by a blast of air introduced into the aperture 76 by alignment of the air-feed hole 80 with the air supply hole 86.

A block or barrel 90 connected to the frame 26 by bolts 92 includes a funnel-shaped channel 94 which surrounds the gauging location 34 when the location 34 is adjacent the block 82. The barrel 90 directs any rivet 18 ejected at that point into the flexible plastic tube 20 for delivery to the bowl feeder 22.

Located above the rotating member 28 is an ejecting mechanism 100 which includes a support 102 pivotally connected to the frame 26 by a pivot 104. The support 102 carries an air cylinder 106 having a rod end 108 reciprocable within a guide member 110. A rivet kicker 112 is supported on the rod 108 for reciprocation therewith along a path above and generally tangential to the periphery 32 of the gauge wheel 28. The cylinder 106 is springloaded to return the kicker 112 to the position shown in FIG. 1. An adjusting screw 114 is threaded through the support 102 forwardly of the pivot 104 and contacts a block 116 carried by the frame 26 to prevent the support 102 from rocking the rivet kicker 112 downwardly beyond a preselected location, preferably just slightly above the periphery the wheel 28. The air cylinder 106 is connected through an air switch 120 (FIG. 2) located below the ejecting mechanism 100 just rearwardly of the gauge wheel 28. The switch 120, which in the preferred embodiment is a Crouzet Model C-705 air switch, commercially available from Miller Fluid Power, Bensonville, IL., includes a valve-operating arm 122 which extends into the path of and is movable by the cam 68 located at each of the gauging locations 34. Therefore as the gauging location 34 reaches a point directly above the axis 30 or at approximately the top center position (FIG. 1), the valve operating arm 122 (FIG. 2) will be depressed to cause the cylinder 106 to move the rivet kicker 112 from the positon shown in FIG. 1 toward the right above the gauging location 34. A rivet 16 having a regularly or uniformly shaped shank 40 (FIG. 5*a*) will be received by the cylindrically shaped gauging aperture 76 so that the head of the rivet is maintained in the gauging location 34 below the path of the rivet kicker 112 as it moves in the direction of the arrow. However, bent (FIG. 5*b*) or burred or gouged (FIG. 5*c*) rivets do not conform to and will not fully settle into the aperture 76, and the heads of such rivets will extend into the path of the rivet kicker 112. As the air cylinder is activated by the switch 120, rivets not fully seated will be ejected from the gauging location 34 to the right, as viewed in FIG. 1, into a tubular member 124 which is supported in alignment with the wheel 28 by the frame 26.

Figure 2:
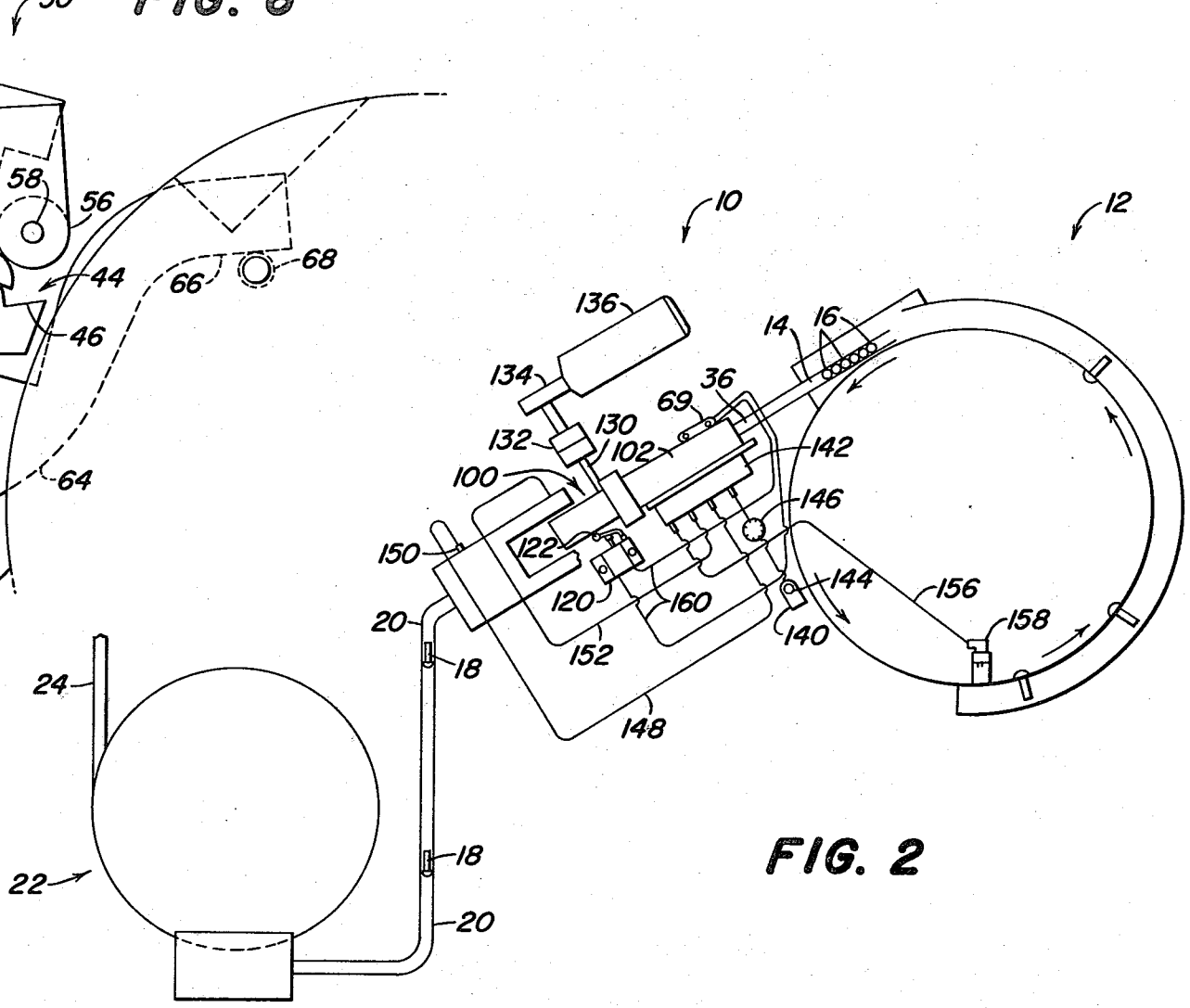
FIG. 2 is a schematic illustration of the rivet sorter shown in FIG. 1 connected between a vibratory bowl sorter and a bowl feeder for a riveting machine.
Figure 3:
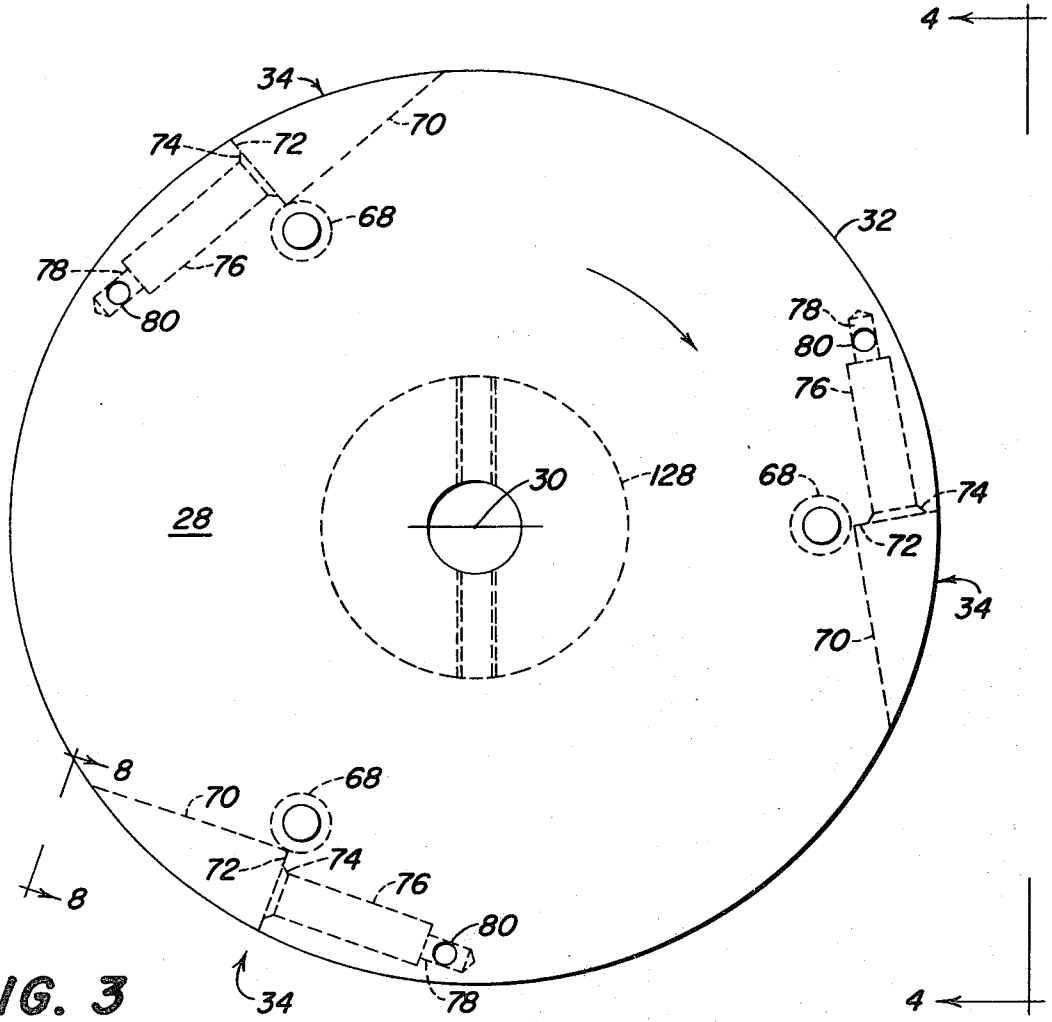
FIG. 3 is a side view of the rotating rivet-receiving member of the sorter shown in FIG. 1.

The rotating member 28 includes a hub 128 pinned to a shaft 130 (FIG. 2). The shaft 130 is driven through a slip clutch 132 connected to a gear reduction unit 134. The reduction unit 134 is driven by a conventional variable-speed electric motor 136 to rotate the member 28 at a suitable speed preferably about 15–20 revolutions per minute. With the wheel 28 shown in FIG. 3, three rivets are gauged per revolution. For rivets with shanks about one inch long, a wheel diameter of about six inches has been found to be satisfactory.

An air supply 140 (FIG. 2) supplies air to a manifold 142 at a pressure of preferably around 80–90 psi through a solenoid valve 144 and a regulator 146. An air line 148 connects the manifold 142 to an air input 150 (FIG. 1) connected to the barrel 90. A continuous supply of air is provided to the input 150 to move the rivets 18 through the tube 20 into the bowl feeder 22 for the riveting machine. A line 152 connects the manifold 142 with the air supply hole 86 to provide a blast of air though each air-feed hole 80 in the rotating member 28 as each gauging location 34 passes the block 82. Another line 156 connects a vibratory bowl cleaner 158 on the presorter 12 to the manifold 142. The lines 160 provide air pressure through the air switch 120 to the air cylinder 106 to reciprocate the rivet kicker 112 when the valve operating arm 122 on the switch 120 is depressed.

Figure 5A:
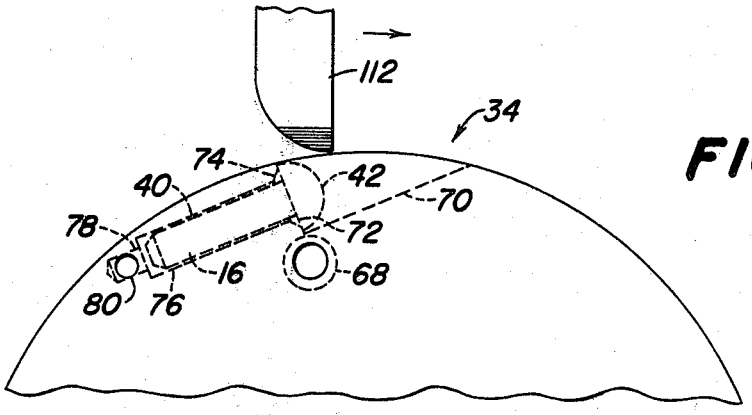
FIGS. 5*a*–5*c* show the locations of rivets of various conditions with respect to the rivet kicker as the member of FIG. 3 is rotated to a position wherein the gauging location is below the ejecting mechanism.
Figure 5B:
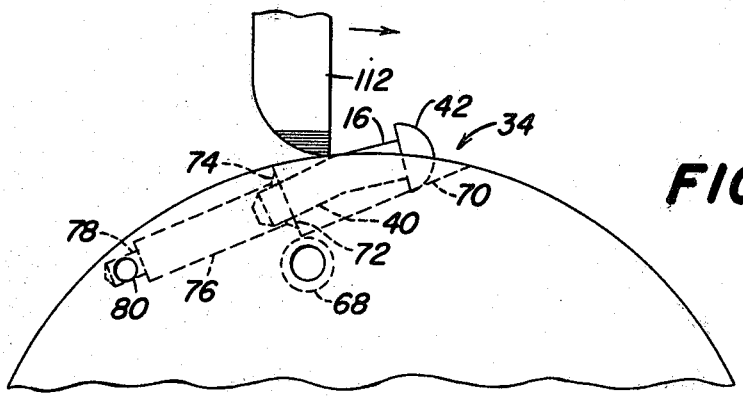
Figure 5C:
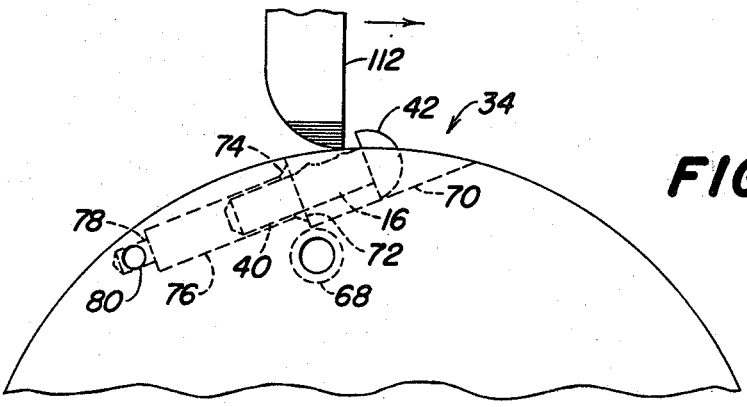

In operation, the rivets 16 are directed from the presorter 12 along the inclined track 36 in a shank-down attitude hanging by their heads 42. The weight of the rivets 16 and vibrations from the vibrator 69 urge the rivets 16 down the track with the lowermost rivet having its head abutting against the roller 56 of the rivet indexing mechanism 5 (FIG. 6). The gauge wheel 28 is rotated in the clockwise direction, and as the cam 68 contacts the camming portion 66 to lift the arm 52, the lowermost rivet settles into the notch 44 (FIG. 7*a*). As the cam 68 moves away from the camming portion 66, the roller 56 rests on the head of the rivet 16 to urge the shank 40 against the rim 32 of the rotating member 28. The rivet indexing mechanism 50 acts as a valve to allow only one rivet as a time into the notch 44. As the gauge wheel 28 rotates in the clockwise direction, the roller 56 acts to bias the head of the rivet into total engagement with the horizontal head-receiving portion 46 of the notch 44. However, until the rounded groove 70 is rotated to a position adjacent the shank (FIG. 7*b*), the head cannot assume a horizontal position because of the close proximity of the notch 44 to the periphery 32 of the wheel 28 and the location of the notch above the left-most (as viewed in FIG. 7) extremity of the wheel. As the wheel rotates to the position shown in FIG. 7*b* with the gauging location 34 horizontally opposite the axis 30 of the wheel 28 wherein the shank 40 enters the rounded groove or guide portion 70, the roller 56 maintains the rivet 16 in the notch 44 with the bottom of the rivet head resting on the horizontal headreceiving portion 46. The rounded groove 70 permits the shank 40 to assume a vertical position generally aligned with the gauging aperture 76. As the gauge wheel 28 is rotated in the clockwise direction from the position shown in FIG. 7*b*, the taper at location 74 directs the bottom of the shank 40 toward the cylindrical gauging aperture 76 and at the same time the rivet is lifted up and out of the notch 44 (FIG. 7*c*) by frictional contact with the gauging location surfaces. The roller 56 urges the head toward the lower surface of the groove 70, and allows the rivet to pass smoothly by the indexing mechanism 50 as the wheel 28 is rotated clockwise beyond the position shown in FIG. 7*c*. As the wheel 28 rotates, the shank 40 will settle or drop substantially by gravity aided by the roller 56 into the aperture 76, provided the shank is not oversized, bent, out of round, burred or otherwise damaged or non-uniform so that it does not conform to the aperture. A properly sized shank will settle completely into the aperture 76 so that the head 42 of the rivet 16 will be contained in the rounded groove 70 just below a preselected boundary which in the preferred embodiment is the periphery or rim portion 32 of the wheel 28 (FIG. 5*a*). As the wheel 28 is rotated so that the gauging location 34 is approximately at the top center position the switch 120 will be activated to reciprocate the air cylinder 106 and cause the rivet kicker 112 to move in a path adjacent to but not touching the head 40 of the rivet (FIG. 5*a*). Therefore the rivet will stay in the gauging location and continue to rotate with the wheel. However if the head 42 of the rivet extends above the periphery 32 of the wheel, for example when the shank 40 is bent (FIG. 5*b*) or gouged (FIG. 5*c*), the rivet kicker 112 will catch the head 42. The defective rivet to be ejected from the gauging location at the top center position and into the tubular member 124 (FIG. 1) as the kicker 112 slides the rivet toward the right. A container 162 is provided for defective rivets at the end of the member 124. If the rivet 16 settles completely into the gauging location 34 (FIG. 5*a*), the rivet will continue to rotate with the wheel 28 to a position beyond the top center position wherein the aperture will be angled downwardly with respect to the horizontal. The rivet 16 will begin to slide out of the gauging location 34 toward the funnel-shaped channel 94 in the barrel 90. The blast of air provided through the airfeed hole 80 from the air supply hole 86 is utilized to positively force the rivet out of the hole 76. Thereafter air supplied through the air input 150 forces the rivet 18 (FIG. 1) through the flexible plastic tube 20 to the bowl feeder 22. In the preferred embodiment the inner diameter of the tube 20 is approximately equal to the diameter of the rivet head.

The adjusting screw 114 can be adjusted to set the sensitivity of the rivet ejecting mechanism 100. By retracting the screw 114 from the support 102, the support pivots downwardly and moves the rivet kicker 112 closer to the periphery of the wheel and increases the sensitivity. By turning the adjusting screw 114 to raise the support 102, the rivet kicker 112 is moved upwardly with respect to the periphery 32, thereby decreasing the sensitivity. The ejecting mechanism 100 is free to rock upwardly about the pivot 104 should the rivet kicker 112 encounter a defective rivet or other obstatcle that might otherwise might cause damage to the ejecting mechansim.

The cam 68 provided on the rear of the wheel 28 at each gauging location times both the rivet indexing mechanism 50 and the ejecting mechanism air switch 120 to rotation of the wheel. As a rivet is removed from the notch 44 to a gauging location 34, the cam 68 lifts the indexing mechanism 50 to allow the next rivet in the inclined track 36 to settle below the roller 56 into the notch 44 to be received by the next gauging location 34. The roller 56 in the rivet indexing mechanism 50 assures a smooth release of the rivet from the notch 44 as the gauging location 34 is rotated thereby.

Acceptable rivets are directed through the tube 20 to the bowl feeder by the supply of air introduced at 150. Conveying the acceptable rivets with air pressure eliminates a manual step of transferring the rivets from the sorter to the feeder.

Having described the preferred embodiment, it will be apparent that modifications can be made without departing from the scope of the invention as defined in the accompanying claims. Although the invention has been described for use as a rivet sorter, it is to be understood that other articles with headed shanks may also be gauged with the present method and apparatus.

We claim:

1. A machine for sorting headed rivets or the like articles having straight, uniform shanks from those having irregular shanks comprising:

a movable gauging member defining an outer boundary and having gauging means for receiving articles with uniform shanks and permitting the article heads associated with the uniform shanks to extend within the boundary while maintaining article heads associated with non-uniform shanks outwardly of the boundary;

first means for guiding the articles toward the gauging member for receipt by the gauging means;

second means for removing to a first location the received articles with heads extending outwardly of the boundary;

third means for removing to a second location the articles with head extending within the boundary; and drive means for moving the gauging member.

2. The machine as set forth in claim 1 wherein the gauging member comprises a wheel with a rim portion and the gauging means includes shank-receiving means extending inwardly from the rim portion conforming to the shape of and for receiving the uniform shanks.

3. The machine as set forth in claim 2 wherein the first means includes track means for guiding the articles one after the other in a shank-down attitude against the rim portion and wherein the drive means rotates the wheel in a forward direction such that the rim portion moves upwardly with respect to the shank.

4. The machine as set forth in claims 1 or 2 wherein the second means comprises ejection means movable adjacent the boundary for contacting the article heads extending outwardly of the boundary.

5. The machine as set forth in claims 1 or 2 wherein the third means comprises means for providing a blast of air to the gauging means and forcing the received article therefrom.

6. The machine as set forth in claim 3 further comprising fourth means located above and rockable up and down with respect to the track means for contacting the article heads and biasing the articles downwardly and toward the rim portion.

7. The machine as set forth in claim 6 wherein the fourth means includes a head-contacting roller and means responsive to the rotation of the wheel for rocking the roller up and down in timed relation to the movement of the rim portion.

8. The machine as set forth in claims 2, 3 or 7 wherein the gauging means includes a rounded guide portion extending from a location on the rim portion toward the shank receiving means and a tapered section connecting the guide portion and the shanks receiving means, so that the shanks are guided toward the shank-receiving means by the rounded guide portion and the tapered section.

9. A machine for sorting headed rivets or the like articles having irregular shanks from those having straight uniform shanks, the machine comprising:

rivet supply means for directing the rivets one after the other toward a first position wherein each succeeding rivet is supported in a shank-down attitude;

wheel means rotatable in a forward direction adjacent the rivet supply means and including an outer rim portion for contacting the shank of the rivet supported at the first position as the wheel means rotates in the forward direction, the wheel means including guide means tapering radially inwardly from the rim portion and terminating in a rivet gauging portion including a shank-receiving hole conforming generally to the shape of and for receiving the straight uniform shanks and for preventing irregular shanks from being fully received therein so the head of an irregular shanked rivet projects radially outwardly beyond a preselected boundary;

means for rotating the wheel means in a forward direction;

first means for ejecting from the wheel means to a first location rivets which project outwardly beyond the preselected boundary; and second means for removing from the wheel to a second location rivets with heads radially inwardly of the preselected boundary.

10. The machine as set forth in claim 9 wherein the first means comprises movable means reciprocable adjacent the rim portion and having a head-contacting portion for removing from the wheel means the irregularly-shanked rivets which have heads projecting radially outwardly, and means timed with the rotation of the wheel means for reciprocating the movable means adjacent the rivet gauging portion.

11. The machine as set forth in claims 9 or 10 wherein the second means comprises an air channel in communication with the shank-receiving hole, and means for directing air through the channel and into the hole to blow the rivets from the hole.

12. The machine as set forth in claim 9 further comprising means located adjacent the rivet supply means and responsive to the rotation of the wheel means for directing the rivets in turn to the first position and urging the shank of the rivet in the first position toward the guide means.

13. The machine as set forth in claim 11 wherein the second means further comprises an air conveyor located between the wheel means and the second location for conveying the rivets blown from the hole toward the second location.

14. A machine for sorting headed rivets or the like articles having uniform cylindrically-shaped shanks from those having non-uniform shanks, comprising;

a gauging member having a rim portion and rotatable about a generally horizontal axis, the member including a gauging location defining a cylindrically-shaped shank-receiving hole extending into the member, the axis of the hole extending generally perpendicular to a line extending radially through the gauging location so that the axis of the hole is substantially vertical when the gauging location is in a preselected position wherein it intersects a horizontal plane through the horizontal axis of the gauging member and wherein the shank-receiving hole has a diameter approximately equal to but slightly larger than the diameter of a uniform shank and has an axial length at least generally approaching the length of a uniform shank;

first means for supporting an article adjacent the preselected position in a shank-down attitude;

second means for rotating the gauging member about its axis in the direction to move the gauging location upwardly with respect to the shank of the supported article;

third means for guiding the shank toward the shank-receiving hole as the gauging location is moved upwardly with respect to the shank and permitting the shank if uniform to settle beyond a preselected location within the hole; and means for removing from the hole those articles which settle beyond the preselected location within the hole.

15. The machine as set forth in claim 14 wherein the third means includes a roller member movably supported above the preselected position and selectively positionable on the head of the supported article.

16. A machine for sorting headed rivets or the like articles having cylindrical shanks with a radius less than or equal to a preselected radius from those articles having non-cylindrically shaped shanks or cylindrically shaped oversized shanks with a radius greater than the preselected radius, the machine comprising:

a movable gauging member having a gauging location defining a cylindrically shaped gauging hole with a radius approximately equal to but slightly larger than the preselected radius and an axial length at least approximately equal to the length of the shank;

means for releasably supporting the articles one after the other in a shank-down attitude adjacent the gauging member;

means for moving the gauging member to move the gauging location upwardly with respect to the means for supporting;

means for guiding the shank of the supported article into the gauging hole as the gauging location is moved upwardly with respect to the means for supporting and permitting the cylindrical shanks with a radius less than or equal to the preselected radius to settle downwardly into the gauging hole beyond a preselected location while maintaining oversized or non-cylindrically shaped shanks above the preselected location; and means responsive to the location of the shank with respect to the gauging hole for selectively directing the article from the gauging member to one of at least two different paths.

17. A method for sorting headed rivets or the like headed articles having irregular shanks from those having straight uniform shanks, including the steps of:

supporting the articles in turn in a shank-down attitude against the periphery of a rotatable gauging device having a gauge hole extending inwardly from the periphery and conforming generally to the shape of a straight, uniform shank;

rotating the gauging device in a forward direction such that the gauge hole moves upwardly with respect to the shank of the supported article;

guiding the shank toward the gauge hole as the gauging device is rotated and permitting the shank to settle in the gauge hole as the hole moves upwardly, wherein the shank of each rivet with a straight, uniform shank will settle fully in the gauge hole and each article with an irregular shank settles less than fully in the hole;

removing each article not fully settled in the gauge hole to a first location; and removing each fully settled article to a second location.

18. The method as set forth in claim 17 wherein the step of removing each article not fully settled in the gauge hole includes the step of reciprocating an ejector adjacent the gauge hole after the step of guiding the shank toward the gauge hole.

19. The method as set forth in claims 17 or 18 wherein the step of removing each fully settled rivet includes introducing a blast of air into the gauge hole.

20. A method for sorting headed rivets or the like headed articles having irregular shanks from those having straight uniform shanks, including the steps of:

supporting in turn each article in a shank-down attitude;

moving a member with a downwardly extending gauging hole upwardly with respect to the supported article;

during the step of moving, guiding the shank of the supported article toward the gauging hole;

during the step of guiding, permitting the shank to drop into the gauging hole whereby a straight uniform shank will drop downwardly to at least a first position relative to the member and an irregular shank will remain above the first position; and removing the article from the member to a first location if the shank is above the first position and to a second location if the shank is at or below the first position.

21. The method as set forth in claim 20 wherein the step of removing the article includes, moving a rivet ejecting member along a path adjacent and generally parallel to the axis of the gauging hole to contact and remove from the hole the article if its shank remains above the first position while avoiding the article if the shank is at or below the first position.

22. The method as set forth in claim 21 including, after the step of moving the rivet ejecting member, introducing a blast of air into the gauging hole to remove any article located therein.

23. A method of supplying gauged rivets having cylindrically-shaped elongated shanks with heads to a riveting machine, including the steps of:

(1) gauging the rivets in turn along substantially the entire length of the shank, the step of gauging including:

(a) providing a gauging location defining a hole with a cylindrically-shaped boundary conforming generally to the shape of the shanks;

(b) axially aligning the shanks in turn with the gauging location hole; and (c) moving in turn each axially aligned shank and gauging location hole towards each other while permitting the shank to settle into the hole, the gauging location and the aligned shank cooperating such that straight shanks with a radius less than that of the radius of the gauging location hole will settle at least to a first location with respect to the hole and shanks either having a radius anywhere along their length greater than the radius of the hole or being bent off-axis along their length will settle less than to the first location; and (2) conveying in turn those rivets with shanks which settle at least to the first location towards the riveting machine.

24. The method as set forth in claim 23 wherein the step of conveying includes:

directing pressured air against the rivets to move the rivet from the gauging location towards the riveting machine.

25. The method as set forth in claims 23 or 24 wherein the step of axially aligning includes supporting the rivet by its head in a shank-down attitude, and the step of moving includes raising the gauging location with respect to the rivet and permitting the shank to settle by gravity into the hole.

* * * * *